US005878995A

United States Patent [19]

Rundle

[11] Patent Number: 5,878,995

[45] Date of Patent: Mar. 9, 1999

[54] LIFTING DEVICE FOR CONCRETE MIXER VEHICLE DRUM

[76] Inventor: Paul E. Rundle, 13271 Highway 64, Wyoming, Iowa 52362

[21] Appl. No.: 752,533

[22] Filed: Nov. 20, 1996

[51] Int. Cl.[6] ..... B66F 3/00

[52] U.S. Cl. ..... 254/133 R; 254/DIG. 4; 254/131; 254/134

[58] Field of Search ..... 254/133 R, 134, 254/DIG. 4, 420, 418, 48, 3 R, 131

[56] References Cited

U.S. PATENT DOCUMENTS

| | | | |
|---|---|---|---|
| 1,559,910 | 11/1925 | Peterson | 254/133 R |
| 1,941,395 | 12/1933 | Graves | 254/133 R |
| 2,355,341 | 8/1944 | Trimbach | 254/3 R |
| 3,567,182 | 3/1971 | Steele | 254/133 R |
| 3,765,650 | 10/1973 | Eisenhauer . | |
| 3,841,604 | 10/1974 | Haynes | 254/134 |
| 3,948,484 | 4/1976 | Tesinsky . | |
| 4,194,726 | 3/1980 | Hance . | |
| 4,607,823 | 8/1986 | Thomas | 254/134 |
| 4,899,985 | 2/1990 | Good . | |
| 5,098,066 | 3/1992 | Wilcox, III | 254/DIG. 4 |
| 5,131,629 | 7/1992 | Hillhouse . | |
| 5,335,407 | 8/1994 | Verkerk . | |
| 5,379,987 | 1/1995 | Cleary . | |

*Primary Examiner*—David A. Scherbel
*Assistant Examiner*—Lee Wilson
*Attorney, Agent, or Firm*—Lathrop & Gage LC

[57] ABSTRACT

An improved device is provided for lifting the drum of a concrete mixer vehicle, wherein the drum has an encircling ring structure. The device includes a body mechanism having a body side wall and an inverted cup with a cavity for receiving a jack, a clamp mechanism wherein a cleat lower wall thereof is slidably adjustable relative to a lower wall of the body mechanism such that a cleat side wall is adjustable toward and away from the body side wall to clamp the ring structure between the body side wall and the cleat side wall, and a stabilizing mechanism for stabilizing the body mechanism relative to the mixer vehicle drum. The device may also include an adapter configured to also be slidably adjustable relative to either the body side wall or the cleat side wall. The stabilizing mechanism, which includes a tongue operably attached to and extending outwardly from the body side wall, a tapped throughbore spaced near a distal end of the tongue, and an axially adjustable adjuster, is configured to operably provide at least a three-point support for the mixer vehicle drum, either by providing the cleat side wall with a concave upper surface for abutting engagement with the drum side wall or by transversely abutting two bolt heads against the ring structure. A method of lifting the mixer drum relative to the mixer vehicle is also provided.

8 Claims, 3 Drawing Sheets

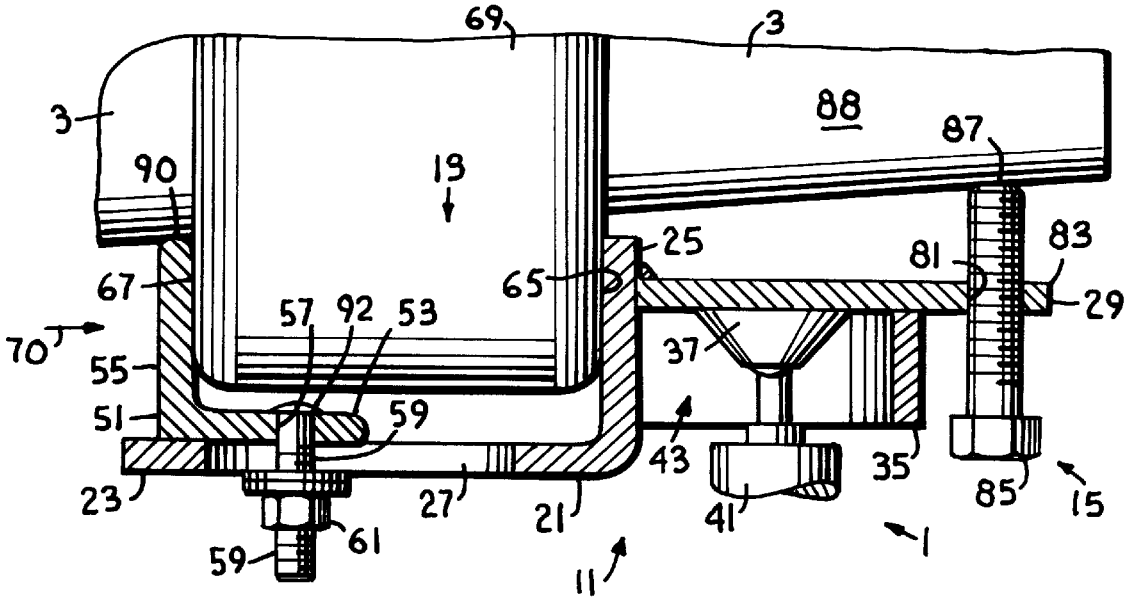
Fig. 5.
Fig. 6.
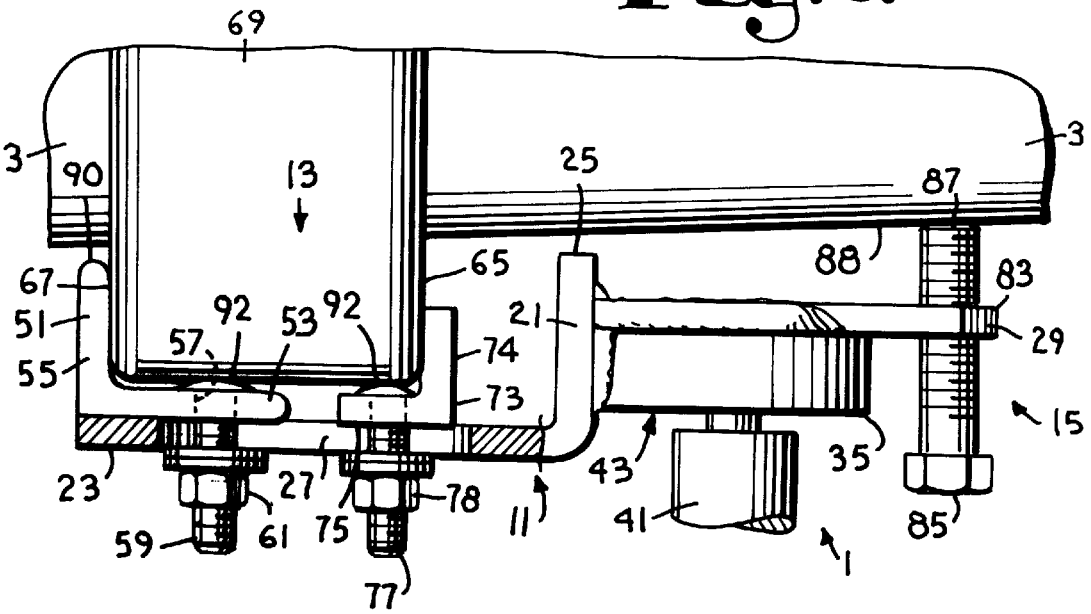

LIFTING DEVICE FOR CONCRETE MIXER VEHICLE DRUM

BACKGROUND OF THE INVENTION

1. Field of the Invention.

The present invention relates generally to a device for lifting a heavy load and, more particularly, to a device for use with a jack to lift a rotatable drum, such as a drum of a concrete mixer truck.

2. Description of the Related Art.

A mixer truck, such as a concrete mixer truck, has a rotating drum structured to contain and mix material en route to a construction site. Rotating capability is generally provided by supporting the drum on bearings, such as roller bearings. From time to time, those bearings must be replaced. Prior to the present invention, a hydraulic jack was more or less jammed into place between a ring structure built into the periphery of the drum and an underlying portion of the drum supporting structure, wherein the jack was generally canted at an angle to the vertical. The jack was then manipulated whereby the drum was lifted from the bearings so the bearings could be removed and replaced. Support for the jack was somewhat haphazard to say the least. Due to the massiveness of the drum, a precarious and dangerous situation existed for the person manipulating the jack. As a result, may accidents occurred when the base of the jack slipped, sometimes pinching off fingers or a hand resulting in serious bodily injury.

What is needed is needed is a device for safely lifting a mixer drum relative to a concrete mixer vehicle, such as a device is configured to prevent slippage of a jack and that literally or equivalently provides a three-point support for the drum as it is being and while lifted by the jack, such as for bearing replacement.

SUMMARY OF THE INVENTION

An improved device is provided for lifting the drum of a concrete mixer vehicle, wherein the drum has an encircling ring structure. The device includes a body mechanism having a body side wall and an inverted cup with a cavity for receiving a jack, a clamp mechanism wherein a cleat lower wall thereof is slidably adjustable relative to a lower wall of the body mechanism such that a cleat side wall is adjustable toward and away from the body side wall to clamp the ring structure between the body side wall and the cleat side wall, and a stabilizing mechanism for stabilizing the body mechanism relative to the mixer vehicle drum. For some applications, the device includes an adapter configured to also be slidably adjustable relative to either the body side wall or the cleat side wall.

Also, for some application, the cleat side wall may have a concave upper surface for abuttingly engaging the wall of the mixer vehicle drum. For other applications, the cleat side wall may be operably spaced apart from the wall of the mixer vehicle drum.

The stabilizing mechanism includes a tongue operably attached to and extending outwardly from the body side wall. The stabilizing mechanism also includes a tapped throughbore spaced near a distal end of the tongue and an adjuster, cooperatively with the throughbore, configured to be axially adjustable. The stabilizing mechanism is configured to operably literally or equivalently provide a three-point support for the mixer vehicle drum.

A method of lifting the mixer drum relative to the mixer vehicle is also provided.

PRINCIPAL OBJECTS AND ADVANTAGES OF THE INVENTION

The principal objects and advantages of the present invention include: providing a device for safely lifting a mixer drum relative to a concrete mixer vehicle to which the mixer drum is mounted; providing such a device for literally or equivalently providing a three-point support for a mixer drum being lifted relative to a concrete mixer vehicle to which the mixer drum is mounter; and generally providing such a device that is reliable in performance, inexpensive to manufacture, capable of long operating life, and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWINGS

FIG. 5 is an enlarged and cross-sectional, side elevational view of the lifting device fitted to the drum of the concrete mixer vehicle, taken along line 5—5 of FIG. 3.

FIG. 6 is an enlarged, partially cross-sectional, side elevational view of the lifting device, according to the present invention.

DETAILED DESCRIPTION OF THE INVENTION

Figure 1:
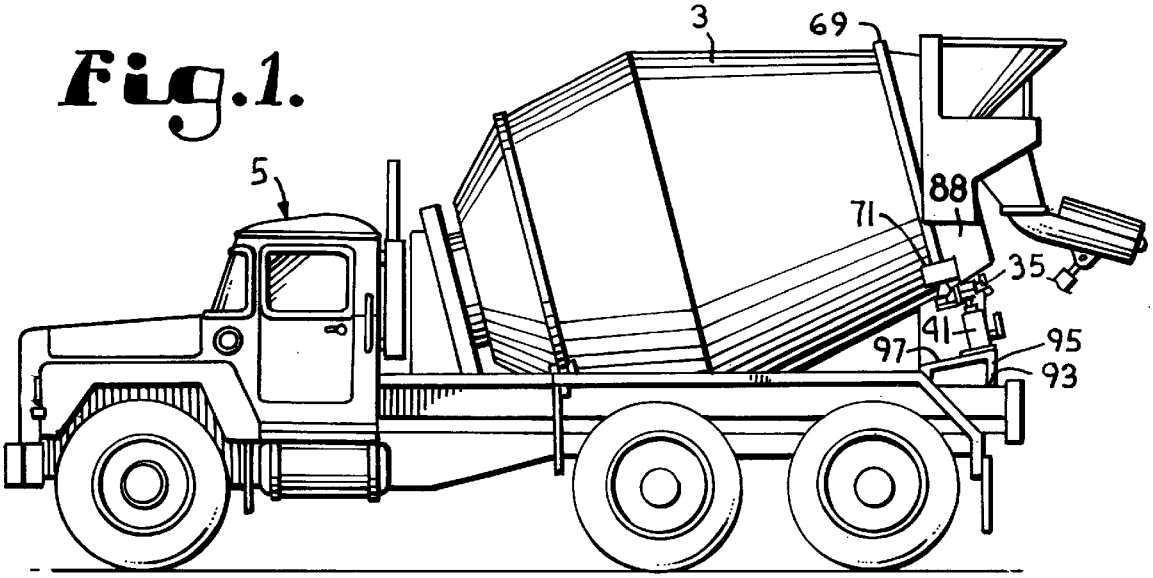
FIG. 1 is a side elevational view of a concrete mixer vehicle and a lifting device being used with a drum thereof, according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a lifting device configured for use with a jack to lift a rotatable drum, such as a drum 3 of a concrete mixer truck or vehicle 5, as shown in FIGS. 1 through 6, according to the present invention.

Figure 2:
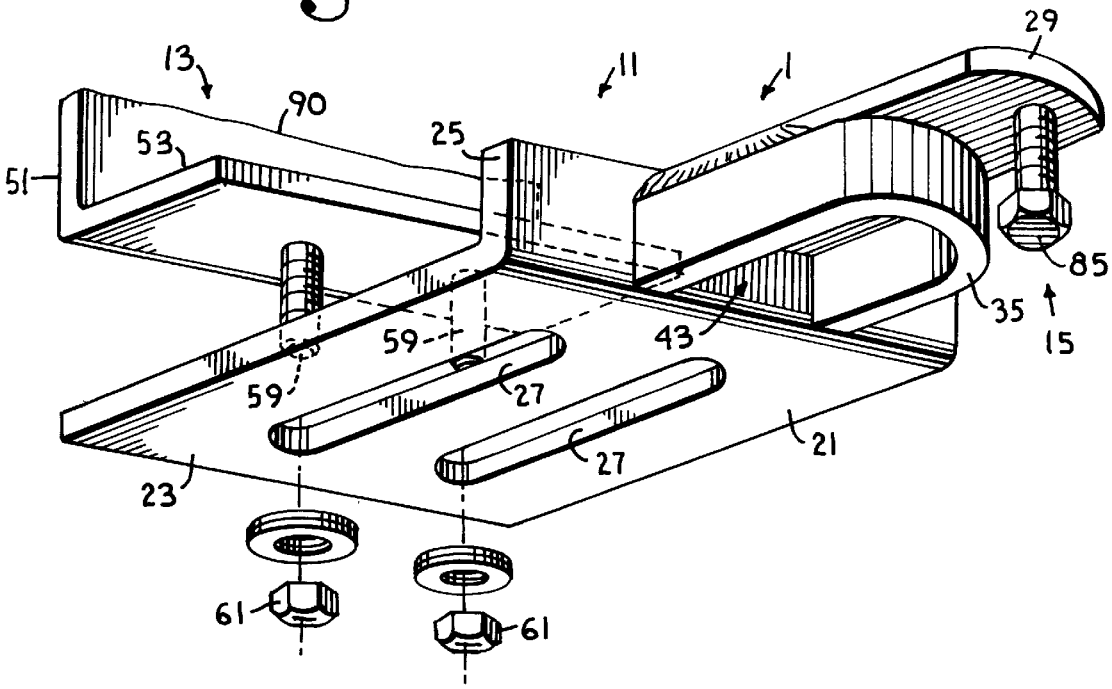
FIG. 2 is an enlarged and perspective, exploded view of the lifting device.

The device 1 includes body means 11, clamping means 13, and stabilizing means 15. The body means 11 includes an L-shaped body 21 having a generally horizontal body lower wall 23 and a generally vertical body side wall 25 joined generally perpendicularly, as shown in FIG. 2. The body lower wall 23 has a pair of parallel spaced throughslots 27 oriented perpendicularly to the body side wall 25.

The body means 11 also includes a tongue 29 rigidly secured to the body side wall 25 such that the tongue 29 extends outwardly from the body side wall 25 and generally parallel to the body lower wall 23. A downwardly directed cup 35 is attached to the tongue 29 and to the body side wall 25. The cup 35 is configured and dimensioned to receive a distal end 37 of a ram 39 of a hydraulic jack 41 into a cavity 43 thereof, as indicated by the arrow designated by the numeral 45 in FIG. 4, such that the distal end 37 is placed in abutting engagement with the tongue 29, as shown in FIG. 5.

The clamping means 13 includes a generally L-shaped cleat 51, having a cleat lower wall 53, a cleat side wall 55, and a pair of throughbores 57 for receiving fasteners therethrough, such as a pair of bolts 59 inserted through the slots 27 and secured by associated nuts 61. For some applications, it may be desirable to fixedly attach the bolts 59 to the cleat lower wall 53.

Figure 3:
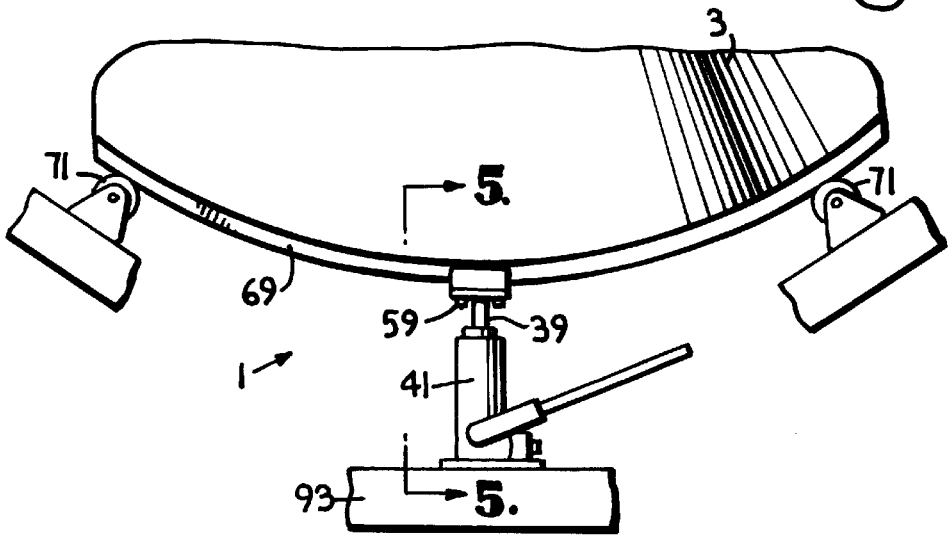
FIG. 3 is a rear elevational view, reduced from that shown in FIG. 2, of the lifting device.
Figure 4:
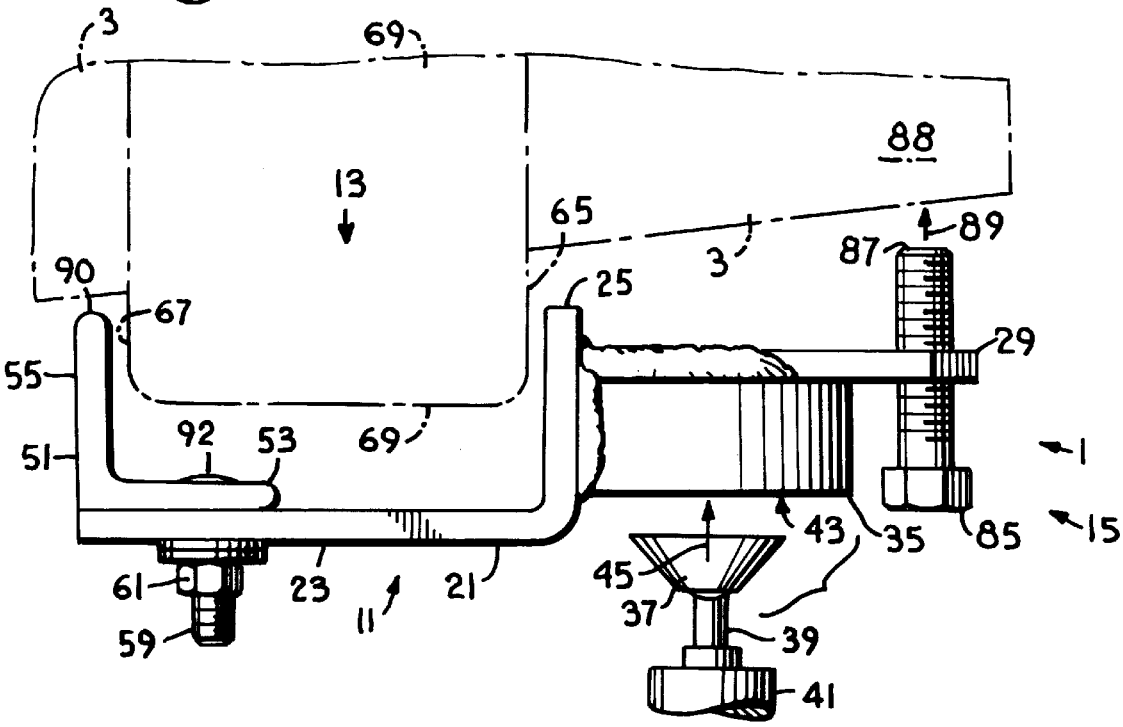
FIG. 4 is an enlarged side elevational view of the lifting device, showing the device being fitted to the drum of the concrete mixer vehicle.

The cleat 51 and the body 21 are cooperatively configured and dimensioned such that the body side wall 25 and the cleat side wall 55 are selectively slidably adjustable toward and away from each other whereby the body side wall 25 and the cleat side wall 55 can be positioned in abutting engagement with opposing sides 65, 67 of a "tire" or ring structure 69 of the drum 3, as indicated by the arrow designated by the numeral 70 in FIG. 5, wherein the ring structure 69 is supported on bearings 71, as shown in FIG. 3, that are to be replaced by use of the device 1.

For some applications, it may be desirable for the device 1 to include an L-shaped adapter 73 having an adapter side wall 74 and an adapter lower wall 75, as shown in FIG. 6. In that event, bolts 77 and nuts 78 may be used through the slots 27 to secure the adapter 73 to the body lower wall 23 such that the cleat side wall 55 and the adapter side wall 74 are cooperatively clamped against opposing sides 65, 67 of the ring structure 69.

The stabilizing means 15 includes extending the tongue 29 beyond the cup 35, as shown in FIG. 5. A tapped throughbore 81 near a distal end 83 of the tongue 29 is configured to threadedly receive an adjuster 85, such as a bolt or other suitable device, such that a distal end 87 of the adjuster 85 can be extended to establish an abutting engagement with a side wall 88 of the drum 3, as indicated by the arrow designated by the numeral 89 shown in FIG. 4.

In an application of the present invention, the nuts 61 of the device 1, sometimes referred to herein as an inverted cup structure, are loosened so the cleat 51 can be slidably adjusted relative to the body 21, as indicated by the arrow 70. The cleat side wall 55 and the body side wall 55 are spaced apart from each other such that the ring structure 69 is straddled, with the cleat side wall 55 and the body side wall 25 clamped against the opposing sides 65, 67 at the lower extremity of the ring structure 69. The nuts 61 are then tightened on the bolts 59 to maintain the positioning of the cleat 51 relative to the body 11.

The cleat side wall 55 and the body side wall 25 may be dimensioned such that the ring structure 69 bears against an upper edge 90 of the cleat side wall 55, as shown in FIG. 5. To operably provide some enhancement of the operable lateral stability of the device 1, the upper edge 90 may be slightly concave, as shown in FIG. 2, in order to operably abuttingly engage the side wall 88 of the drum 3. Such abutting engagement of the concave upper edge 90 with the side wall 88 of the drum 3 provides, at least, a transversely spaced two-point contact against the side wall 88 of the drum 3.

Alternatively, the extent to which the cleat side wall 55 extends away from the cleat lower wall 53 may be limited such that the ring structure 69 operably abuttingly engages heads 92 of the pair of bolts 59 if desired, as shown in FIG. 6, instead of the cleat side wall 55 operably abuttingly engaging the side wall 88 of the drum 3 as aforesaid. Such bearing by the ring structure 69 against the heads 92 of the pair of bolts 59 provides a two-point contact along the circumference of the ring structure 69, also providing some enhancement of the lateral stability of the device 1.

Further enhancement of the stability of the device 1 is provided by threadably advancing or retracting the bolt 85 as needed, as indicated by the arrow 89, such that the distal end 87 of the bolt 85 bears against the drum side wall 88, maintaining the fore-and-aft alignment of the cleat side wall 55 and the body side wall 25 with the ring structure 69. In other words, the bolt heads 92, in conjunction with the bolt 85, literally operably provide three-point support for the drum 3 as the drum 3 is being lifted and while lifted relative to the truck 5 by the jack 41. Alternatively, the concave upper edge 90, in conjunction with the bolt 85, operably provides at least a three-point support for the drum 3 as the drum 3 is being lifted and while lifted relative to the truck 5 by the jack 41.

The jack 41 is then placed on an appropriate underlying structure, such as a bed 93 of the truck 5 or a secure platform 95 having an upper surface 97 oriented at an appropriate angle to provide reliable support for the jack 41, such that the distal end 37 of the ram 39 of the jack 41 is received in the cavity 43 of the cup 35, as indicated by the arrow 45. The ring structure 69 and drum 3 are then jacked generally vertically, lifting the ring structure 69 clear of the roller bearings 71. After the roller bearings 71 have been removed and replaced, the jack 41 is released, returning the ring structure 69 to its bearing support.

It is to be understood that while certain forms of the present invention have been illustrated and described herein, it is not to be limited to the specific forms or arrangement of parts described and shown.

What is claimed and desired to be secured by Letters Patent is as follows:

1. A device for use with a jack to lift a mixer vehicle drum having a ring structure, the device comprising:

(a) body means for receiving the jack; said body means including a body having a body side wall;

(b) clamping means for clamping said body means to the ring structure; said clamping means including a cleat connected to said body, said cleat having a cleat side wall such that the ring structure is operably spaced between said body side wall and said cleat side wall, wherein said cleat is mounted to said body such that said cleat side wall is slidably adjustable toward and away from said body side wall; and (c) stabilizing means for stabilizing said body means relative to the mixer vehicle drum.

2. A device for use with a jack to lift a mixer vehicle drum having a ring structure, the device comprising:

(a) body means for receiving the jack; said body means including a body having a body side wall and a body lower wall;

(b) clamping means for clamping said body means to the ring structure; said clamping means including a cleat connected to said body, said cleat having a cleat side wall such that the ring structure is operably spaced between said body side wall and said cleat side wall; said cleat including a cleat lower wall configured to be slidably adjustable relative to said body lower wall; and (c) stabilizing means for stabilizing said body means relative to the mixer vehicle drum.

3. The device according to claim 2, wherein said clamping means also includes an adapter configured to be slidably adjustable relative to said body side wall.

4. The device according to claim 2, wherein said clamping means also includes an adapter configured to be slidably adjustable relative to said cleat side wall.

5. A device for use with a jack to lift a mixer vehicle drum having a ring structure, the device comprising:

(a) body means for receiving the jack; said body means including a body having a body side wall;

(b) clamping means for clamping said body means to the ring structure; said clamping means including a cleat connected to said body, said cleat having a cleat side wall such that the ring structure is operably spaced between said body side wall and said cleat side wall, wherein said cleat side wall operably abuts a side wall of the mixer vehicle drum and has an upper edge operably abutting the wall of the mixer vehicle drum, said upper edge having a concave profile; and (c) stabilizing means for stabilizing said body means relative to the mixer vehicle drum.

6. A device for use with a jack to lift a mixer vehicle drum having a ring structure, the device comprising:

(a) body means for receiving the jack; said body means including a body having a body side wall;

(b) clamping means for clamping said body means to the ring structure; said clamping means including a cleat connected to said body, said cleat having a cleat side wall such that the ring structure is operably spaced between said body side wall and said cleat side wall; and (c) stabilizing means for stabilizing said body means relative to the mixer vehicle drum; said stabilizing means including:

(1) a tongue operably attached to and extending outwardly from said body side wall, said tongue having a tapped throughbore near a distal end thereof, and (2) an adjuster configured to be axially adjustable relative to said tongue.

7. A device for use with a jack to lift a mixer vehicle drum having a ring structure, the device comprising:

(a) body means for receiving the jack; said body means including a body having a body side wall;

(b) clamping means for clamping said body means to the ring structure; said clamping means including a cleat connected to said body, said cleat having a cleat side wall such that the ring structure is operably spaced between said body side wall and said cleat side wall; and (c) stabilizing means for stabilizing said body means relative to the mixer vehicle drum; said stabilizing means including said cleat side wall having a concave upper surface configured to operably abuttingly engage a side wall of the drum adjacent to the ring structure.

8. A method for lifting a mixer drum relative to a mixer vehicle, to which the mixer drum is mounted, with a jack wherein the mixer drum includes a ring structure, the method comprising the steps of:

(a) providing an inverted cup structure for receiving an upper end of the jack;

(b) clamping the cup structure to the ring structure such that at least a three-point supporting contact is established between said cup structure and the mixer drum; and (c) lifting the mixer drum relative to the mixer vehicle with the jack.

* * * * *